United States Patent [19]

Lill et al.

[11] 3,975,033

[45] Aug. 17, 1976

[54] SAFETY SKI BINDING

[75] Inventors: Viktor Lill, Schwechat; Ernst Rossler, Vienna; Josef Svoboda, Schwechat; Erwin Weigl, Brunn am Gebirge, all of Austria

[73] Assignee: Gertsch AG, Zug, Switzerland

[22] Filed: June 5, 1975

[21] Appl. No.: 584,106

[30] Foreign Application Priority Data

June 14, 1974 Austria ..... 4946/74
Oct. 9, 1974 Austria ..... 8103/74

[52] U.S. Cl. ..... 280/618; 280/633
[51] Int. Cl.[2] ..... A63C 9/086
[58] Field of Search ..... 280/11.35 K, 11.35 E, 280/11.35 Q, 11.35 D, 11.35 A, 11.35 C, 11.35 Z, 11.26

[56] References Cited

UNITED STATES PATENTS

| | | | |
|---|---|---|---|
| 1,458,243 | 6/1923 | Reach | 280/11.26 |
| 3,284,092 | 11/1966 | Rumaner | 280/11.35 K |
| 3,314,687 | 3/1967 | Tiesler | 280/11.35 C |
| 3,489,424 | 1/1970 | Gertsch et al. | 280/11.35 K |
| 3,773,344 | 11/1973 | Wilkes | 280/11.35 C |
| 3,790,186 | 2/1974 | Kanno | 280/11.35 C |
| 3,798,691 | 3/1974 | Notermann | 280/11.35 E |
| 3,876,218 | 4/1975 | Von Besser | 280/11.35 K |

*Primary Examiner*—M. H. Wood, Jr.
*Assistant Examiner*—David M. Mitchell
*Attorney, Agent, or Firm*—Woodhams, Blanchard and Flynn

[57] ABSTRACT

A safety ski binding having a sole plate releasably secured to a ski between a pair of holding parts. The sole plate includes a toe gripping device for gripping over the toe of a ski boot and, in addition, a heel holding device adjustable in the longitudinal direction for holding the heel of the ski boot to the sole plate. The heel holding device is connected to a carriage member which is composed of two parts, both movable relative to the other. One of the parts is fixable by a locking device in several positions on the sole plate to fix the carriage member relative to the sole plate.

14 Claims, 9 Drawing Figures

SAFETY SKI BINDING

FIELD OF THE INVENTION

The invention relates to a safety ski binding having a sole plate which is releasably secured between holding parts on the ski, and which sole plate includes a toe support which grips over the toe of the ski boot and a heel holding device adjustable in longitudinal direction of the sole plate.

BACKGROUND OF THE INVENTION

In a known binding of the foregoing type, the sole holder is adjustable on the sole plate in a longitudinal direction to adjust to various boot sizes. For this purpose, the part which grips over the heel is connected to a cable and the ends of the cable have bent boltlike devices secured to the sole plate. The bent ends of the bolts have threads and project into lateral openings in the sole plate. They are there held by means of nuts. For adjustment, the nuts must be removed from the bent bolts, the bolts and the nuts must be removed from the sole plate and must be arranged in and screwed into other openings or recesses. This is a very expensive and complicated manipulation.

In a different known device, a guide rail is mounted on the ski, on which an elongated slide plate is guided having a front support and a heel plate. The heel plate supports a heel holder. Screws are provided to fix this unit on the guide rail. After releasing these screws, the slide plate with its front support and heel plate can be pulled off from the guide rail. Only then exists the possibility, to adjust the heel plate relative to the elongated slide plate, whereby an elevation engages one of several openings. Then these two parts, slide plate and heel plate, must be held together until they are again guided into the guide rail. Only then are these two parts held to one another. In order to now hold the entire unit nonmovably on the guide rail, the screws must again be tightened. This device is also very expensive and complicated to handle.

The purpose of the invention is to overcome these disadvantages and to produce a device wherein an adjustment, namely adaption to various sizes of boot soles, can take place in a simple manner very quickly. This purpose is attained by connecting the heel holder to a carriage member which is composed of two parts which are movable relative to one another, of which one can be fixed by a lock in several positions on the sole plate. Here the lock can be released in a simple manner by lifting one part of the carriage member from the other one and by moving the carriage member as a whole and fixing same in the desired position.

The two parts, which are connected to the sole plate are held together in an advantageous manner by the force of a spring and an adjustment can be effected practically only by one manipulation by overcoming the force of the spring to move the two parts apart to permit the carriage member to be adjusted.

BRIEF DESCRIPTION OF THE DRAWINGS

The subject matter of the invention is illustrated exemplarily in several embodiments in the drawings, in which:

FIG. 2 is a cross-sectional view taken along the line II—II of FIG. 3;

FIGS. 4 and 5 are associated views of a different embodiment, wherein FIG. 4 is a cross-sectional view taken along the line IV—IV of FIG. 5;

FIGS. 6 and 7 are also associated views of a further modified embodiment, wherein FIG. 6 is a cross-sectional view taken along the line VI—VI of FIG. 7.

DETAILED DESCRIPTION

Figure 1:
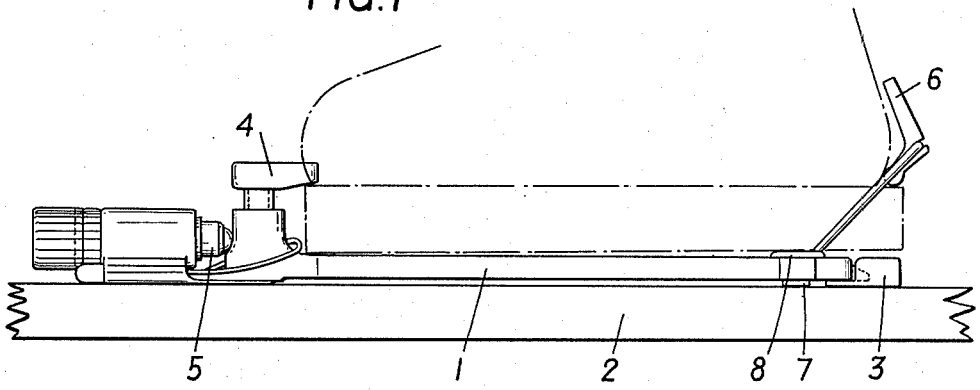
FIG. 1 is a side elevational view of an arrangement of a sole plate on a ski.

As one can recognize from FIG. 1, a sole plate 1 on which is mounted a ski boot is releasably secured to a ski 2. The sole plate 1 is held in engagement with the ski in the rear zone of the ski boot by the heel holding device 3 and cooperates at the front zone with a locking pin 12 which is spring loaded by a release spring (not illustrated). A toe engaging support 4 grips over the sole of the ski boot at the front zone thereof and a heel holder 6 grips over the sole of the ski boot in the rear zone thereof. The heel holder 6 is connected to a carriage member 7,8 which is movable with respect to the sole plate and can be adjusted and fixed in various longitudinal positions on the sole plate 1.

The sole plate can be released from engagement with the ski either in the front area or in the rear area, both laterally and also upwardly. If, for example, a safety release takes place in the rear area, then the rear end of the sole plate 1 slides off out of the heel holding device 3 and the locking pin 5 is moved forwardly against the force of the release spring due to the forward movement of the sole plate 1.

Figure 2:
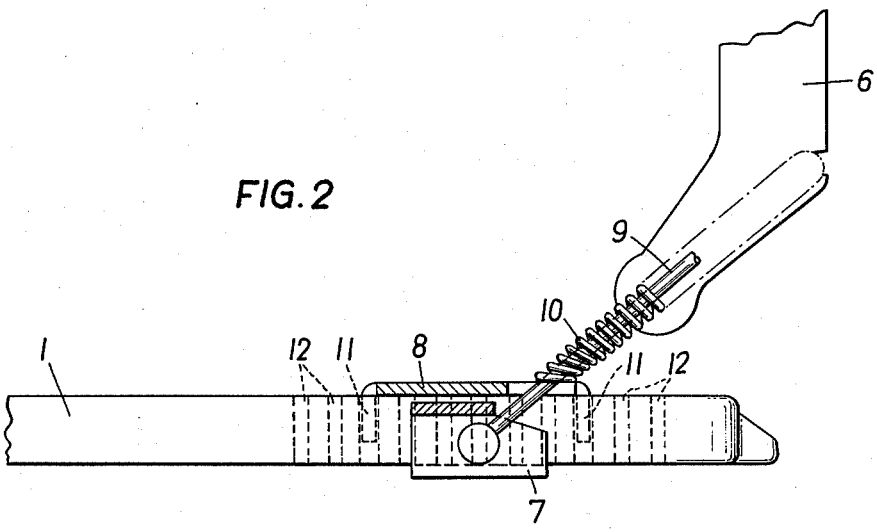
FIGS. 2 and 3 are side and bottom views, respectively, of an inventive adjusting device, whereby
Figure 3:
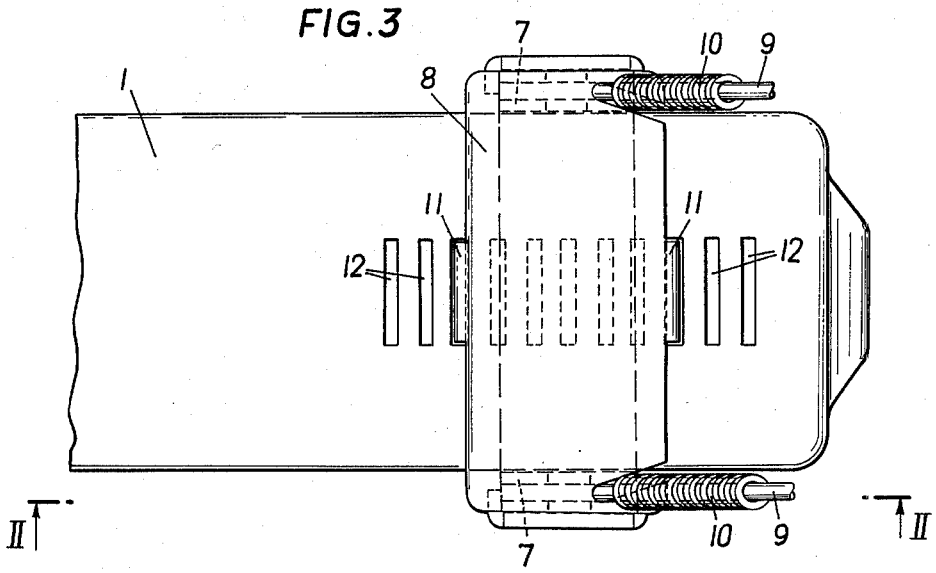

From FIGS. 2 and 3 one can see the special construction of the carriage member and its possibilities for adjustment. The carriage member consists of two slide parts 7,8, which practically grip around the sole plate. The heel holder 6 is connected to a cable 9 and the ends of the cable 9 are connected to a slide part 7. The cable 9 is surrounded by Bowden windings 10, which engage and extend between another slide part 8 and the heel holder 6. The Bowden windings 10 do not lie very closely against one another, so that they practically form a spring, which, as stated above, is supported on the slide part 8 and thus holds the two slide parts 7,8 to one another in the illustrated position. The slide part 8 has a pair of longitudinally spaced bent portions forming projections 11 which are received in corresponding longitudinally spaced recesses 12 in the sole plate 1.

To adjust to a certain boot size, the slide part 8 is lifted upwardly against the force of the resilient Bowden windings 10. The projections 11 are thereby removed from the recesses 12 of the sole plate 1. The device is now unlocked and can be moved longitudinally relative to the sole plate 1. In the required position, the projections 11 are then moved into another set of recesses 12 and are held by the resilient action of the Bowden windings 10. Thus the adjustment is very simple and can be carried out quickly.

Figure 4:
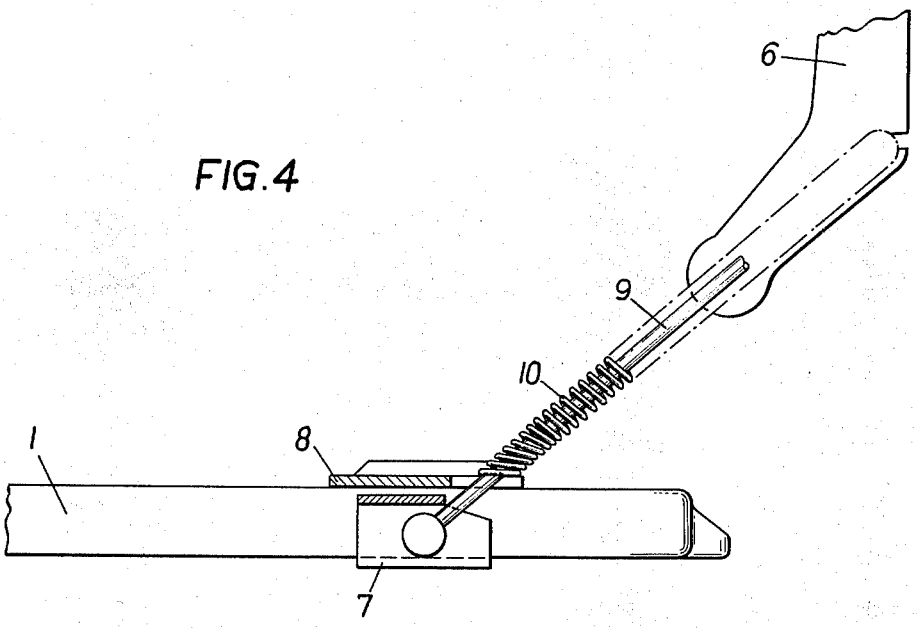
Figure 5:
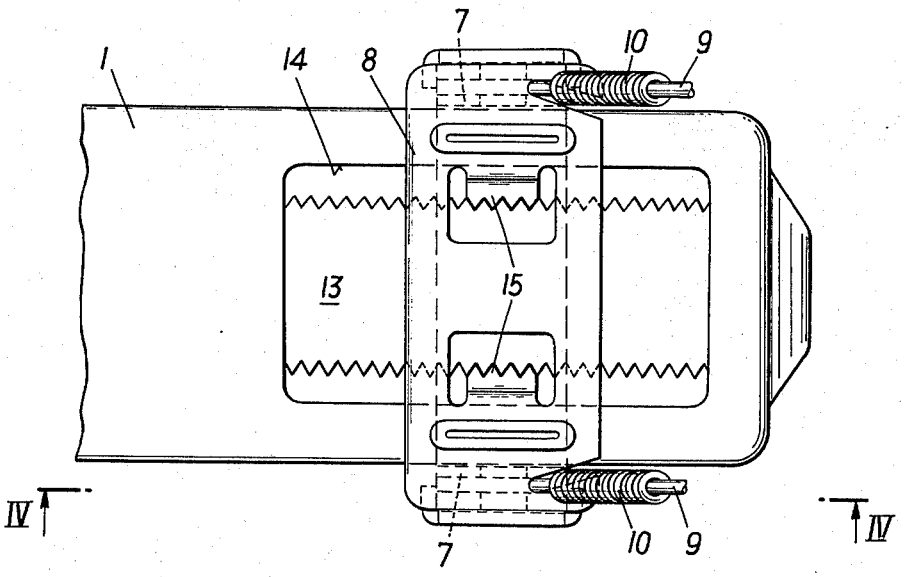

The construction according to FIGS. 4 and 5 differs from the preceding exemplary embodiment only in providing a tooth construction in place of the projections and recesses. Therefore, the same reference numerals have been used for the same parts. The tooth construction is defined by a rack rail 13, which is secured in a recess 14 in the sole plate 1. The rack rail 13 has two laterally spaced and longitudinally extending rows of teeth. The upper slide part 8 has two downwardly extending tabs 15 having teeth at their ends which engage the teeth on the rack rail 13. To effect an adjustment to a certain boot size, it is only necessary to lift the upper slide part 8 against the force of the resilient Bowden winding 10, so that the teeth of the parts 13 and 14 become disengaged. It is thereafter possible to shift the entire device longitudinally of the ski and the teeth can engage, in the desired position, another set of teeth on the rack rail 13. The resilient Bowden windings 10 will maintain the teeth on the tabs 15 in engagement with the teeth on the rack rail 13.

Figure 6:
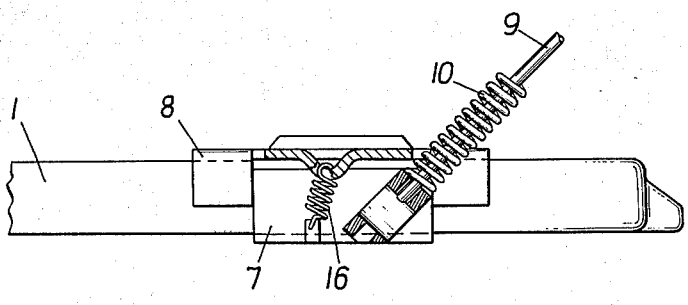
Figure 7:
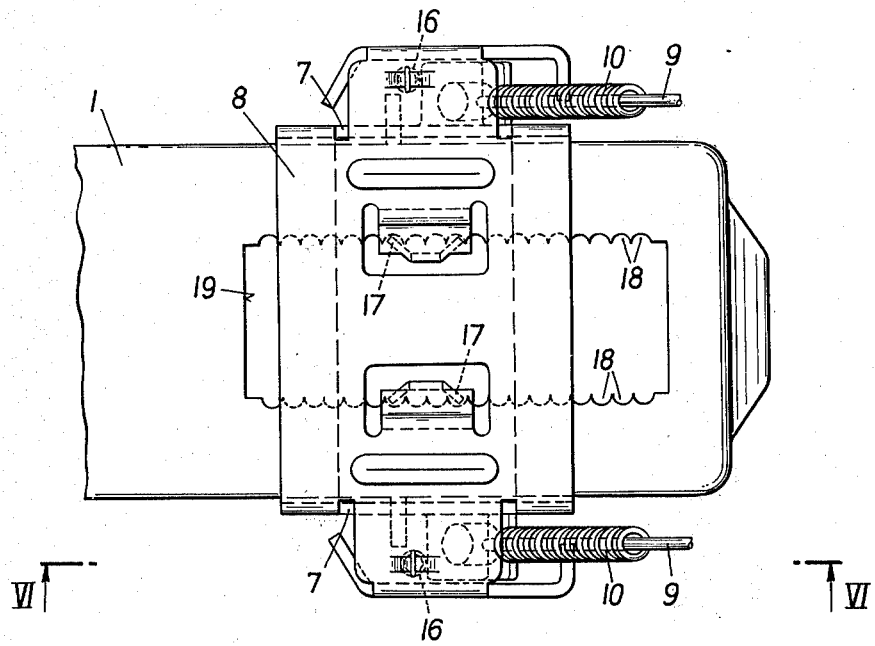

In the construction according to FIGS. 6 and 7, the cable 9 is connected, together with the Bowden windings 10, to the slide part 7. The slide part 8 can be moved relative to the slide part 7 against the force of two separately provided springs 16, of which each end is connected to and extends between the slide part 7 and the slide part 8. Downwardly extending teeth 17 are formed on the slide part 8, which teeth engage teeth 18 arranged in the base plate. These teeth 18 are formed on opposite walls of a recess 19 in the sole plate 1. Thus the sole plate 1 and the teeth 18 are on one part and, therefore, can be simply and inexpensively manufactured, for example by an injection molding process. To adjust to a certain boot sole size, the slide part 8 is lifted up against the force of the springs 16, whereby the tooth construction 17, 18 become disengaged. The entire device can thereafter be shifted to a new location and held thereat by engagement of the tooth constructions 17,18 and by the springs 16.

Figure 8:
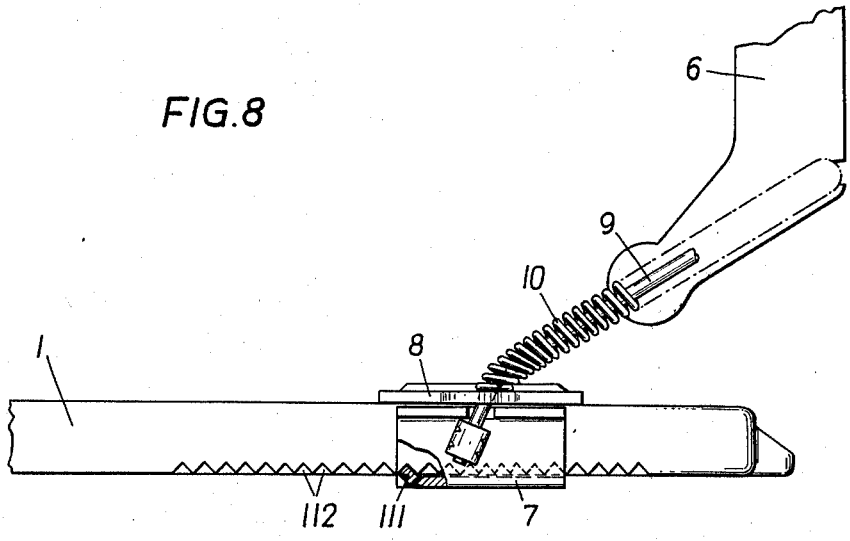
FIGS. 8 and 9 are front and bottom views, respectively, of a last exemplary embodiment.
Figure 9:
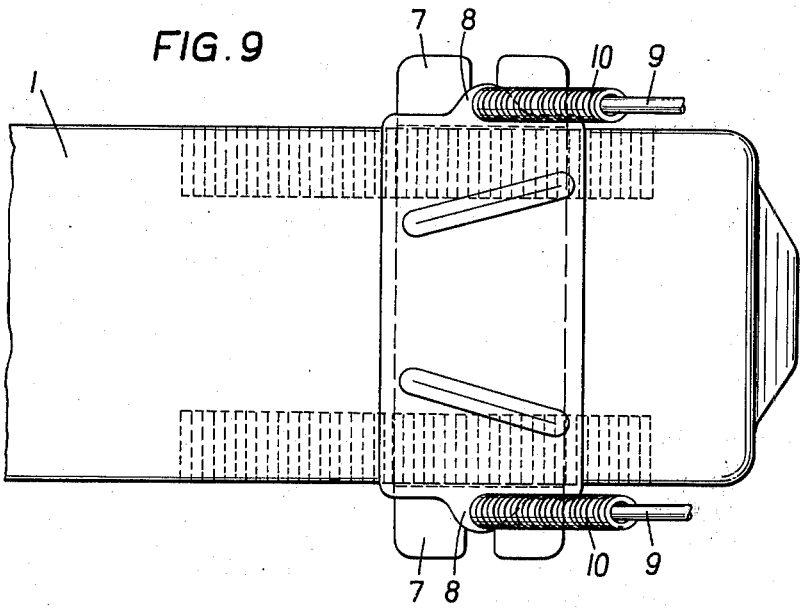

In the construction according to FIGS. 8 and 9, the carriage member consists also of two parts 7,8, which practically surround the sole plate 1. The heel holder 6 is connected to the cable 9 and the ends of the cable 9 are connected to the slide part 7. The cable 9 is surrounded by Bowden windings 10, which engage the other slide part 8. The Bowden windings 10 do not lie very closely together, so that they practically form a spring which, as stated above, is supported on the slide part 8 and thus holds the two slide parts 7,8 to one another in the illustrated position. The slide part 7 has bent portions having a plurality of teeth 111 thereon, which teeth engage a plurality of teeth 112 on the sole plate 1.

To effect an adjustment to a certain boot size, the slide part 7 is pressed downwardly against the force of the resilient Bowden windings 10. The teeth 111 become disengaged from the teeth 112 on the sole plate 1. The device is now unlocked and can be removed relative to the sole plate 1. In the desired position, the teeth 111 will again engage the teeth 112 and the engagement maintained by the resilient action of the Bowden windings 10. Thus, the adjustment can be carried out simply and quickly.

The invention is not to be limited to the illustrated exemplary embodiments. A number of construction possibilities exist, which lie within the scope of the invention. For example, it is also possible to connect other binding parts, for example, cableless heel bindings, with the slide part 8, according to FIGS. 6 and 7.

The embodiments of the invention in which an exclusive property or privilege is claimed are defined as follows:

1. A safety ski binding, comprising:

a sole plate and releasable securement means for securing said sole plate to a ski;

spaced first locking means on said sole plate;

toe engaging means mounted on said sole plate for engaging and holding a toe of a ski boot to said ski;

movable heel engaging means movably mounted in a longitudinal direction on said sole plate for movement toward and away from said toe engaging means and for engaging and holding a heel of said ski boot to said sole plate, said heel engaging means including first and second vertically spaced slide members slidingly engaging vertically spaced surfaces on said sole plate and on opposite lateral sides thereof, one of said first and second slide members having second locking means thereon engaging said spaced first locking means on said sole plate to fixedly locate said movable heel holding means in a desired location on said sole plate; and spaced first and second resilient means engaging at least opposite lateral sides of said one of said first and second slide members and urging said opposite lateral sides thereof toward the other of said first and second slide members to clamp said sole plate therebetween and urging said first and second locking means into engagement with each other whereby a relative movement away from each other of said first and second slide members against the urging of said first and second resilient means to effect on equal spacing between the lateral sides of said first and second slide members will effect a release of the engagement between said first and second locking means to facilitate said longitudinal movement of said heel engaging means relative to said sole plate.

2. A safety ski binding according to claim 1, wherein said heel holding means includes a cable secured to opposite lateral sides of said other of said first and second slide members and extends around the heel portion of said ski boot;

wherein said one of said first and second slide members has a pair of openings therein for receiving said cable therethrough; and wherein said first and second resilient means are springs encircling said cable and resiliently engaging the upper surface of said one of said first and second slide members to urge same toward the other of said first and second slide members and said upper surface of said sole plate.

3. A safety ski binding according to claim 1, wherein said first and second resilient means each includes a spring being secured to and extending between said first and second slide members.

4. A safety ski binding according to claim 1, wherein said second locking means includes a pair of laterally spaced toothed tabs; and wherein said spaced first locking means include laterally spaced and elongated toothed rails each engaged by one of said toothed tabs.

5. A safety ski binding according to claim 4, wherein said elongated toothed rails are integral with said sole plate.

6. A safety ski binding according to claim 4, wherein said sole plate has a recess therein and wherein said elongated toothed rails are located in said recess.

7. A safety ski binding according to claim 1, wherein said sole plate has a plurality of spaced holes aligned in a straight line parallel to the longitudinal axis of said ski and defining said spaced first locking means; and wherein said one of said first and second slide members has at least one projection thereon defining said second locking means received in at least one of said holes.

8. A safety ski binding according to claim 7, wherein said projection and said holes are rectangular in cross section.

9. A safety ski binding according to claim 8, wherein two projections are provided on said one of said first and second slide members and spaced a distance equal to a multiple of the spacing between individual ones of said holes.

10. A safety ski binding according to claim 1, wherein said second locking means includes a pair of spaced locking elements thereon.

11. A safety ski binding according to claim 10, wherein said pair of spaced locking elements are laterally spaced on said one of said first and second slide members.

12. A safety ski binding according to claim 11, wherein said pair of locking elements each include at least one tooth thereon; and wherein said first locking means on said sole plate includes a pair of parallel rows each having a plurality of teeth therein.

13. A safety ski binding according to claim 12, wherein said first locking means are located on the upper surface of said sole plate.

14. A safety ski binding according to claim 10, wherein said pair of spaced locking elements are laterally spaced on the other of said first and second slide members; and wherein said first locking means are located on the lower surface of said sole plate.

* * * * *